US006453839B2

(12) United States Patent
Roeseler et al.

(10) Patent No.: US 6,453,839 B2
(45) Date of Patent: Sep. 24, 2002

(54) SELF STABILIZING TOW APPARATUS

(75) Inventors: Cory Roeseler; Andreas H. von Flotow, both of Hood River, OR (US)

(73) Assignee: Hood Technology Corporation, Hood River, OR (US)

( * ) Notice: Subject to any disclaimer, the term of this patent is extended or adjusted under 35 U.S.C. 154(b) by 0 days.

(21) Appl. No.: 09/772,426

(22) Filed: Jan. 29, 2001

Related U.S. Application Data

(60) Provisional application No. 60/179,524, filed on Feb. 1, 2000.

(51) Int. Cl.[7] ..... B63B 21/04

(52) U.S. Cl. ..... 114/253; 114/242; 114/121; 114/102.16

(58) Field of Search ..... 114/242, 244, 114/246, 247, 253, 254, 126, 121, 102.1, 102.11, 102.12, 102.13, 102.16, 102.18, 102.22, 255, 125

(56) References Cited

U.S. PATENT DOCUMENTS 398,631 A * 2/1889 Lässoe ..... 114/246
606,104 A * 6/1898 Twining ..... 114/39.28
1,853,794 A * 4/1932 Arman ..... 114/254
3,336,895 A * 8/1967 Nelson ..... 114/246
3,469,552 A * 9/1969 Patrick ..... 114/246
3,838,660 A * 10/1974 Frisbee ..... 114/246
4,497,272 A * 2/1985 Veazey ..... 114/102.29
4,729,333 A * 3/1988 Kirby et al. ..... 114/244
4,798,157 A * 1/1989 Duret ..... 114/253
4,864,954 A * 9/1989 Farrar ..... 114/103
5,732,642 A * 3/1998 DeSilva ..... 114/103
5,740,754 A * 4/1998 Harvey et al. ..... 114/273
5,896,825 A * 4/1999 Trefethen ..... 114/39.28
6,237,521 B1 * 5/2001 Müller ..... 114/102.29

* cited by examiner

*Primary Examiner*—S. Joseph Morano
*Assistant Examiner*—Ajay Vasudeva
(74) *Attorney, Agent, or Firm*—Bell, Boyd & Lloyd LLC

(57) ABSTRACT

When it is beneficial for a towing craft, such as a boat, to tow from a point high above its center, an airfoil can be fastened to a tether for improved roll and yaw stability. In the case of a wakeboarder, the upward tow angle afforded by a tall tower improves the wakeboarder's performance, but it causes the towboat to roll excessively when the wakeboarder pulls to the side. An aerodynamic surface can be linked to the tether to safely oppose the rolling moment of the wakeboarder. When the wakeboarder pulls out to the side of the towboat, the angle of attack on the aerodynamic surface increases proportionally, and the lateral forces approximately cancel. The boat proceeds safely with little or no roll perturbation.

8 Claims, 6 Drawing Sheets

SELF STABILIZING TOW APPARATUS

The present application claims the benefit of U.S. Provisional Patent Application 60/179,524, filed Feb. 1, 2000, the entire contents of which are hereby incorporated by reference and relied upon.

BACKGROUND OF THE INVENTION

1. Field of the Invention

The present invention relates to a tower or pylon mounted towing device whereby aerodynamic forces are coupled to the tether for stabilizing and/or steering the tow vehicle.

2. Description of the Related Art

Wakeboarding has become the gymnastics of waterskiing. Competitive wakeboarders score points by vaulting from the wake of a towboat and flipping, twisting, and grabbing high over the water's surface. Higher, longer jumps are preferred. Towboats are modified to enhance the wakeboard experience and provide a better show for the spectators. Extra ballast is loaded into the boat and sometimes the hull is modified to form larger wakes. Extended pylons and towers extend upward from modern ski boats to provide a higher tether attachment. The higher attachment helps the wakeboarder to jump higher and stay up longer, but it has the adverse effect of rolling, and sometimes steering, the boat when the wakeboarder pulls hard outside the wake.

The possibility of wakeboarders capsizing their craft have limited the practical use of extended pylons and towers to a height of about 7 feet for boats 22 feet and under. Larger vessels, such as sport fishing boats, are equipped with much taller towers, but the bulky size, high cost, fuel consumption and awkward road handling make these impractical towboats for most wakeboarders and waterskiers.

Movable roll stabilizers are common on the hulls of larger vessels for the sole purpose of reducing the rolling action caused by unsteady seas. They are usually of the submersible type and act upon the hydrodynamic forces exerted as when a dorsal fin is rotated about an axis that is angled to nearly intersect the ship's centerline. They are usually controlled by mechanical actuators and a feedback loop within the vessel.

It is, therefore, the object of this patent application to provide a pylon mounted towing device whereby aerodynamic forces are coupled to the tether for stabilizing and/or steering the tow vehicle.

SUMMARY OF THE INVENTION

The present application discloses a stabilizing device comprising an attachment point positioned high above a towboat, a tether connecting said towboat to a towed subject and an aerodynamic surface whose angular position is guided by said tether, and which acts to roll stabilize said towboat as said towed subject applies lateral loads.

In a preferred embodiment of the device, the aerodynamic surface further comprises a leading edge, a trailing edge and a sail area, and the sail area is sized and articulated to counter rolling moments applied by the towed subject.

In other preferred embodiments, the attachment point is elevated by a structure selected from the group consisting of a mast, a pylon, a bridge and a tower and the towed subject is a wakeboarder or waterskier. Slots may be cut into the aerodynamic surface to achieve a higher lift coefficient.

In other preferred embodiments, the device may be folded down for stowage or road travel and the device when folded down supports a shelter against harmful sunrays or adverse weather. In yet other preferred embodiments, the aerodynamic surface is used to display advertisements.

DETAILED DESCRIPTION OF THE INVENTION

Figure 1:
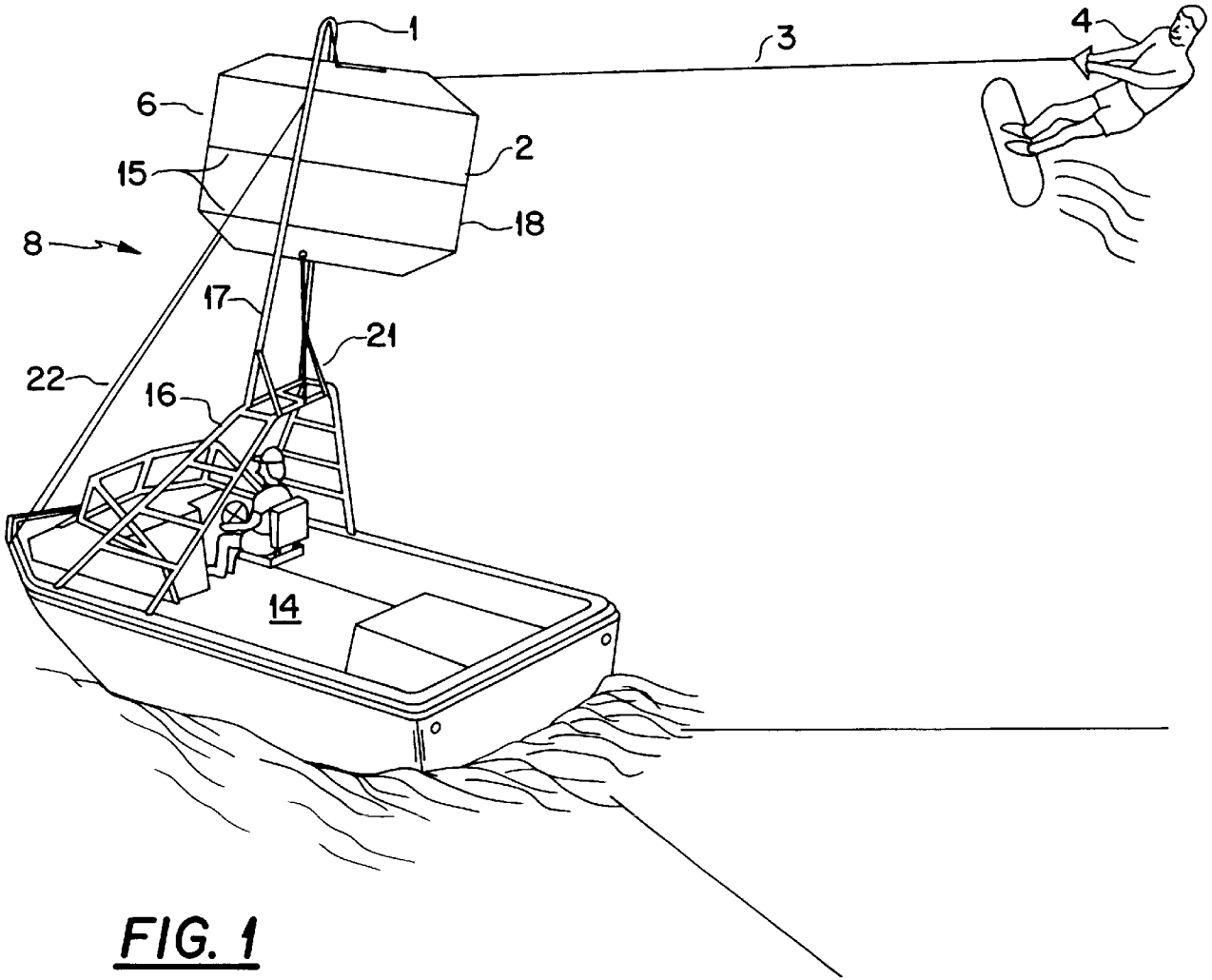
FIG. 1 is an isometric view of a towboat pulling a wakeboarder with the aerodynamic surface deployed.

The following numbers are used to designate the following elements throughout this application:

1. attachment point;
2. aerodynamic surface;
3. tether;
4. towed subject;
5. towing angle;
6. leading edge;
7. side force
8. headwind;
9. heel angle;
10. slots;
11. force vector;
12. halyard;
13. downhaul;
14. tow boat;
15. battens;
16. tower;
17. extension;
18. trailing edge;
19. pylon
20. bimini top
21. backstay
22. forestay The preferred embodiment of the present invention provides for a means to substantially raise the attachment point 1 for a tether 3 while maintaining, or even improving, the safety and seaworthiness of the tow boat 14. The invention employs an aerodynamic surface 2 to counter the side force applied by the towed subject 4. The attachment point 1 of the tether 3 is rigidly mounted to the hull structure by any combination of elevating means including, but not limited to pylons, A-frames, shroud lines, fore-stays, bridges and/or towers. It may have a swivel-type mount for the tether to reduce chaffing.

The aerodynamic surface 2 is comprised of a leading edge 6, a trailing edge 18, and an area of fabric that lies between said leading edge 6, and trailing edge 18. The aerodynamic surface 2 is tensioned vertically by a downhaul 13. A halyard 12 may be used to raise and lower the system, and rigid battens 15 may be used to keep the aerodynamic surface 2 taught. The towed subject 4 and tether 3 control the angular position of the aerodynamic surface with respect to the boat's centerline. When the towed subject steers itself to the starboard side of the towboat as in FIG. 1, the aerodynamic surface 2 uses the relative headwind 8 to force the attachment point 1 in the port direction. The angle of attack of the aerodynamic surface 2 on the headwind 8 varies proportionally as the towed subject steers itself harder to the side. Since the side force 7 (or lift $F_L$) generated by the aerodynamic surface 2 varies with angle of attack, the righting moment of the aerodynamic surface 2 increases in approximate proportion to the over-turning moment applied by the towed subject 4 (see FIG. 2). The matching of these moments is achieved by selecting the appropriate size and lift coefficient of the aerodynamic surface.

Figure 3:
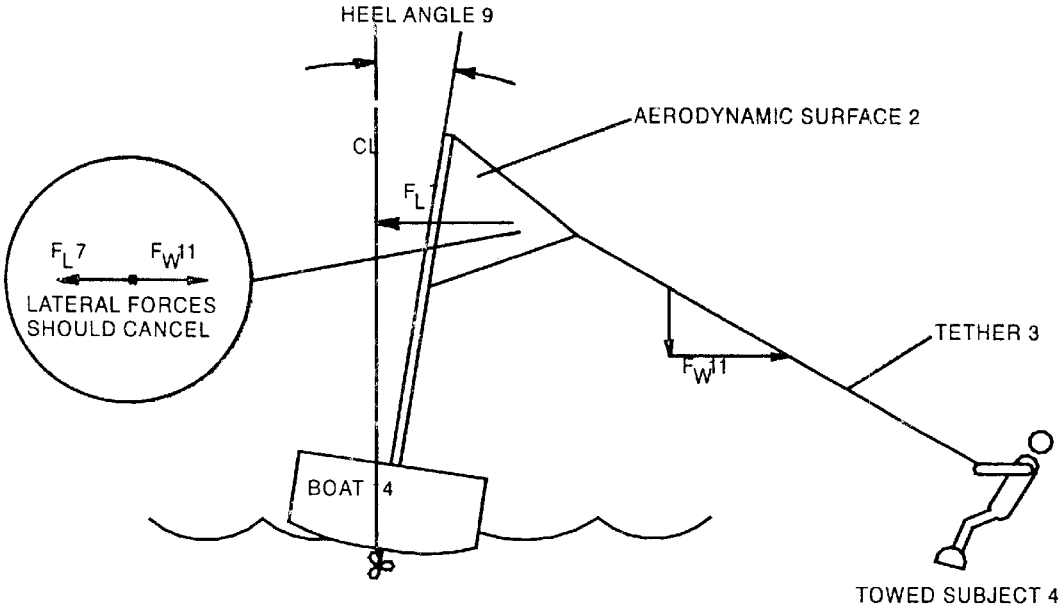
FIG. 3 is an end view force diagram showing the rolling moments applied by the towed subject, and the aerodynamic stabilizing force $F_L$ applied by the aerodynamic force.

The rolling moment is calculated by multiplying the height of the attachment point 1 by the lateral component of the tow rope force vector 11 when seen from the end view of the boat. The effect of lateral forces in a typical wakeboard application is depicted in FIG. 3.

The righting mechanism for a planing ski boat is largely governed by hull geometry. A wide, flat, hull with hard chines provides good roll stability for small roll angles. Beam is generally limited to about 7 feet to ease road travel while an automobile is towing the boat. Furthermore, an excessively wide mono-hull pounds and slaps its way through waves, while a narrower hull with a vee shape in the forward section cuts gracefully through the chop. It is for this narrower, more practical watercraft design that the present invention may provide the most benefit.

Figure 5:
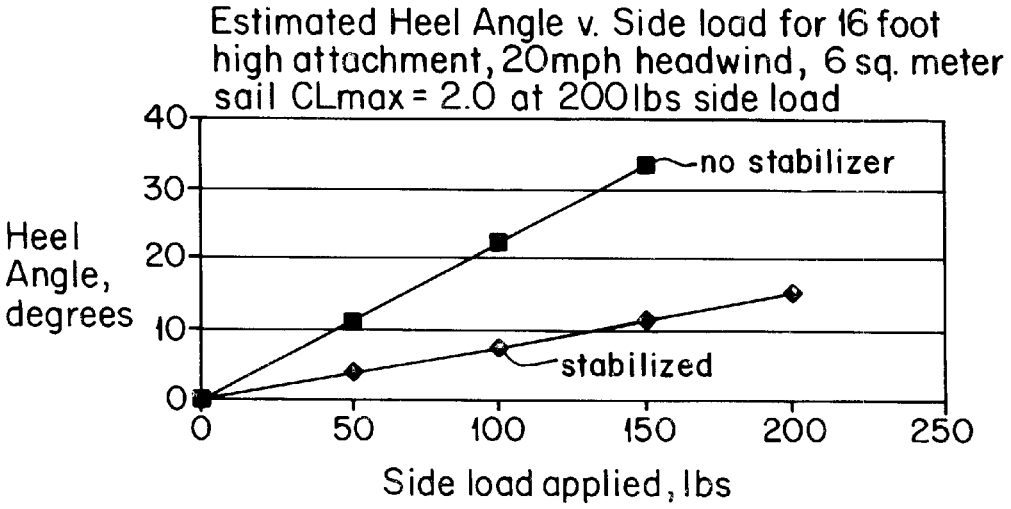
FIG. 5 is the estimated heel angle plotted versus lateral load applied for a typical wakeboard situation. Heel angles are compared with and without the benefit of the aerodynamic stabilizer.

Since the purpose of the invention is to stabilize the boat in the roll direction, the area of said aerodynamic surface 2 is optimized to keep the heel angle 9 to a minimum. When the towing angle 5 is equal to zero degrees, the boat's heel angle, 9 is substantially unaffected by the towed subject (see FIG. 5).

However, when the towing angle 5 is non-zero, the aerodynamic surface 2 assumes an attack angle on the relative wind 8. The required area for the aerodynamic surface 2 to counter the lateral component of the tow rope force vector 11 is determined by the following equation:

$$S=2F_L/C_L r\ U^2$$

Let $F_L$ equal $F_w$=500 Newton, the density of air at sea level be r=1.2 Kg/meter$^3$, relative wind 8 equals boat speed, U, equal 8 meter/sec, and lift coefficient, $C_L$ for the aerodynamic surface equals 2.0. Then S=6.5 meters$^2$ (71 ft$^2$).

Figure 4:
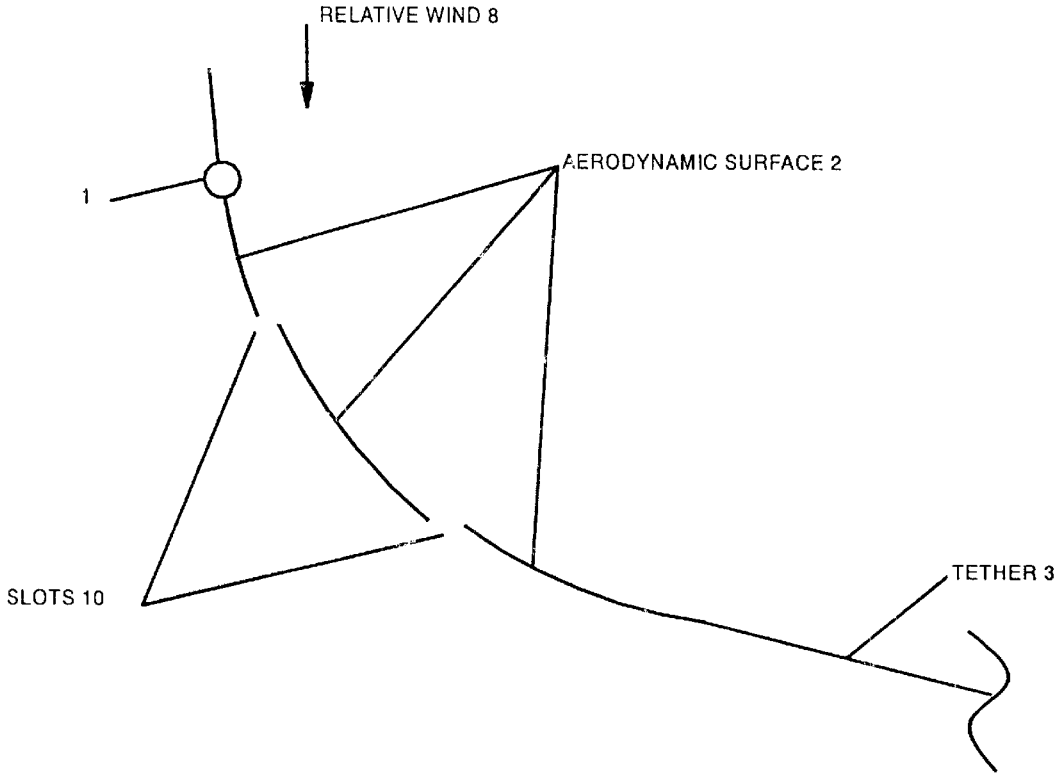
FIG. 4 shows that a slotted airfoil may be used as the aerodynamic surface for better lift coefficient and to prevent stall at high angles of attack.

To further enhance the performance of the stabilizer, slots 10 may be incorporated in the design of the aerodynamic surface 2 to achieve a higher lift coefficient. The slotted airfoil may also perform better at higher angles of attack, as in FIG. 4.

Figure 2:
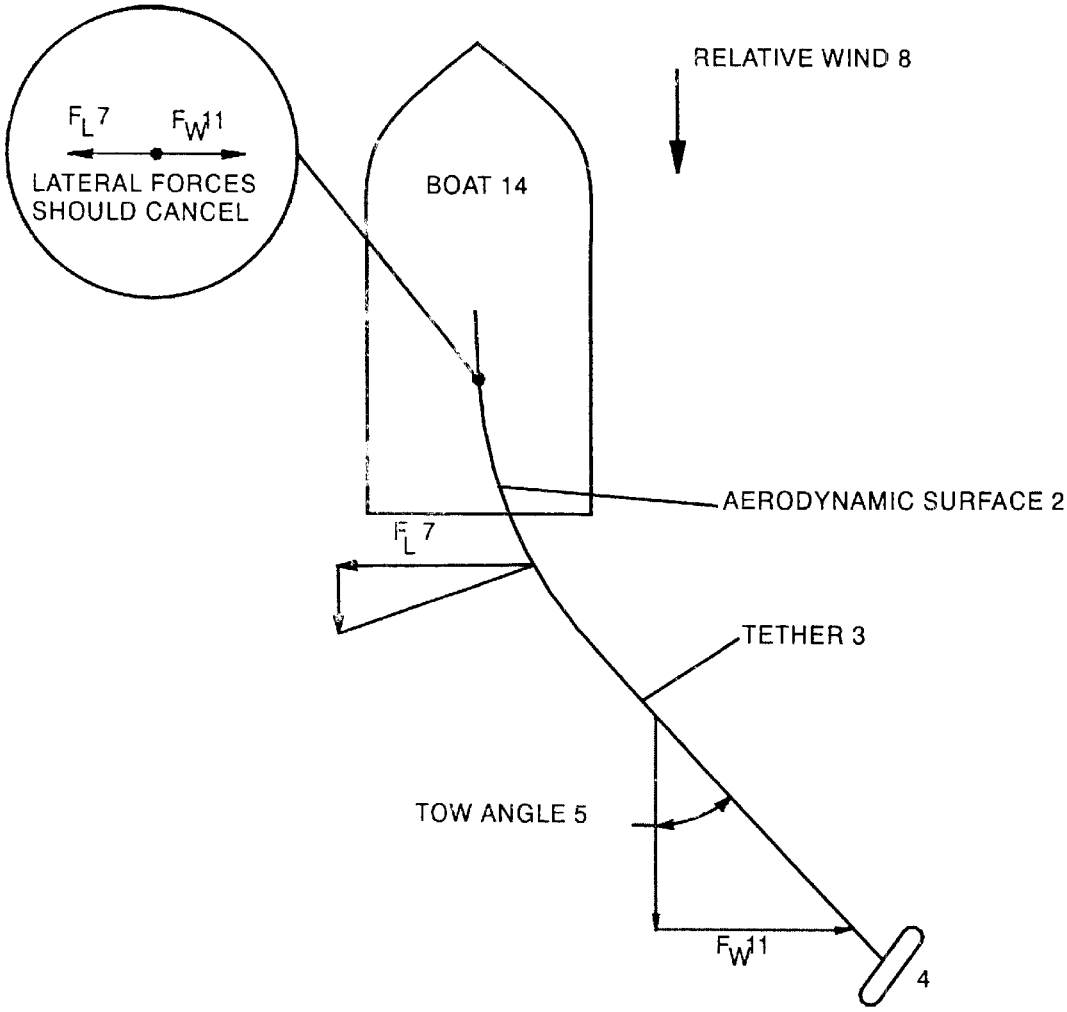
FIG. 2 is a top view force diagram showing the estimated forces exerted by the towed subject and the aerodynamic stabilizer on the towboat.

For towboats 14 already equipped with a tower 16, an extension 17 may be added to support the aerodynamic stabilizer 2 and further elevate the attachment point 1 (see FIG. 1). Backstays 21 and forestays 22 provide support for the extension 17.

Figure 6:
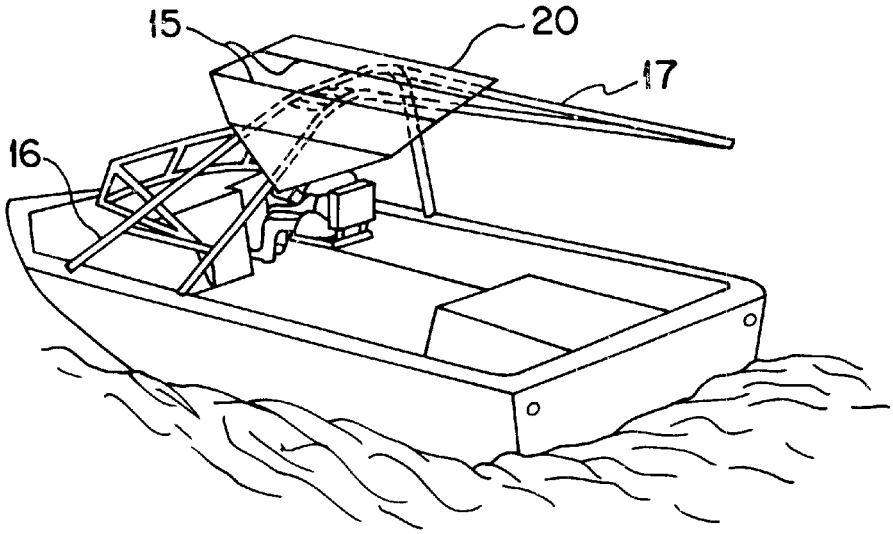
FIG. 6 shows the present invention in its stowed position (for road travel, etc) as a bimini top for protection against harmful sunrays or rain.

Bimini tops (or sun-shades) are commonly found on recreational boats to block out direct sunrays. The present invention may take the form of a bimini top 20 in its stowed position (see FIG. 6). The battens 15, provide for/aft structure for the aerodynamic surface 2, which becomes the fabric of the bimini.

Figure 7:
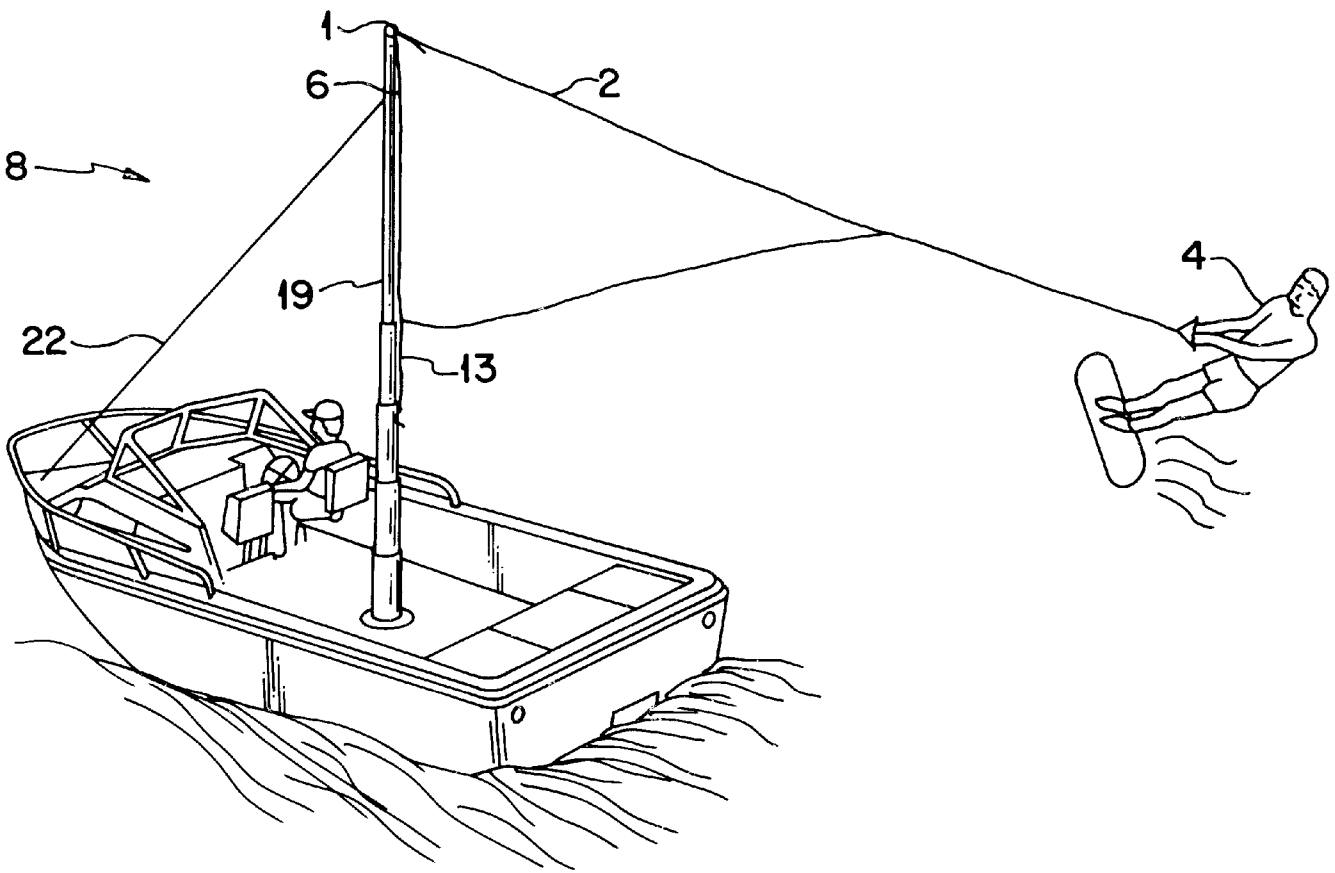
FIG. 7 is an isometric view of an alternative embodiment whereby, a towboat is equipped with a pylon 19, which supports a pennant-shaped aerodynamic stabilizer. This embodiment does not mandate the use of battens 15, since the aerodynamic surface 2, remains aft of the attachment point 1 of the hard structure.

FIG. 7 shows an isometric view of an alternative embodiment whereby, a towboat is equipped with a pylon 19, which supports a pennant-shaped aerodynamic stabilizer. This embodiment does not mandate the use of battens 15, since the aerodynamic surface 2, remains aft of the attachment point 1 of the hard structure.

Commercial advertisements are commonly found on recreational vessels. An aerodynamic surface held aloft is a prime target for such advertising. Publicists will likely use the aerodynamic surface for such advertising.

While the invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the appended claims.

Thus, it is to be understood that variations in the present invention can be made without departing from the novel aspects of this invention as defined in the claims. All patents and articles cited herein are hereby incorporated by reference in their entirety and relied upon.

What is claimed is:

1. A stabilizing device comprising:

a) an attachment point positioned above a motorized towboat;

b) a tether connecting said towboat to a towed subject; and c) an aerodynamic surface whose angular position is guided by said tether, and which acts to stabilize said towboat against rolling moments as said towed subject applies lateral loads, wherein said aerodynamic surface further comprises:

1) a leading edge, 2) a trailing edge, and 3) a sail area.

2. The device of claim 1, wherein said sail area incorporates aerodynamic slots.

3. The device of claim 1, wherein said sail area is sized to counter rolling moments applied by the towed subject.

4. The device of claim 1, wherein said attachment point is elevated by a structure selected from a group consisting of a mast, a pylon, a bridge and a tower.

5. The device of claim 4, wherein the aerodynamic surface is fixed to the structure so as to block out harmful sunrays or protect a boat crew from adverse weather.

6. The device of claim 1, wherein said device is adaptable to be foled down for stowage or road travel.

7. The device of claim 6, wherein the device when folded down supports a shelter a shelter against weather.

8. The device of claim 1, wherein the aerodynamic surface is used for advertisements.

* * * * *